United States Patent [19]

Sawamura et al.

[11] Patent Number: 4,879,954

[45] Date of Patent: Nov. 14, 1989

[54] FOLDABLE TABLE

[76] Inventors: Masahiko Sawamura, 481 Sashima; Kouji Takahashi, 192 Ashina, both of Yokosuka, Kanagawa-ken, Japan

[21] Appl. No.: 462,770

[22] Filed: Feb. 1, 1983

[30] Foreign Application Priority Data

Jan. 2, 1982 [JP] Japan ..... 57-12796[U]

[51] Int. Cl.[4] ..... A47B 3/00

[52] U.S. Cl. ..... 108/6; 123/1; 243/135; 292/216

[58] Field of Search ..... 108/1, 2, 6, 8; 248/183, 184, 185; 292/210, 216

[56] References Cited

U.S. PATENT DOCUMENTS 2,016,571 10/1935 Barrett ..... 108/6 X
2,030,348 2/1936 Barrett ..... 108/6 X
2,860,938 11/1958 Marti ..... 108/2
3,236,551 2/1966 Nash ..... 292/216 X
3,239,260 3/1966 Beckman et al. ..... 292/216 X
4,073,520 2/1978 Tsuchiya et al. ..... 292/216

FOREIGN PATENT DOCUMENTS 27125 of 1903 United Kingdom ..... 108/6

*Primary Examiner*—Peter R. Brown

[57] ABSTRACT

Disclosed is a foldable table whose table plate may be readily and easily folded down with a single operation of a knob and restored back to its horizontal position simply by lifting up the table plate as a natural motion of bringing the table plate to such a position through the use of a pair of cams mounted on a table plate bracket. One of the cams keeps the table plate in its horizontal position by engaging a stopper pin fixed from a support while the other cam releasably engages the first cam to the engaged state.

9 Claims, 3 Drawing Sheets

III
III
1
2
2
3
4
5
6
7
8
9
10
11
12
13
14
15
16
18
19
20
22
23

II
II
1
2
3
4
6
7
8
9
19
20
23

FOLDABLE TABLE

FIELD OF THE INVENTION

This invention relates to a foldable table, in particular to a foldable table whose table plate may be folded down and restored back to the original horizontal position with a simple operation of a pair of cams.

BACKGROUND OF THE INVENTION

The inventors have hitherto seen various foldable tables, but they were all highly complicated in structure making them expensive to manufacture and undurable in use. Furthermore, the inventors have never seen such a foldable table which can be folded down with a single operation and can be restored to the usable state by applying a natural lifting motion to its table plate, through the use of a pair of cams.

We have found that the use of a pair of cams in a foldable table can make its folding mechanism highly smooth in action, convenient in operation and durable in use.

OBJECTS OF THE INVENTION

In view of such shortcomings of conventional foldable tables and based on our finding, a primary object of this invention is to provide a foldable table which may be folded down with the use of a pair of cams.

Another object of this invention is to provide a foldable table which may be restored from its folded position to a horizontal position simply by pushing up the table plate to its horizontal position.

Yet another object of this invention is to provide a foldable table which is simple in structure, reliable in use and economical to manufacture.

SUMMARY OF THE INVENTION

According to the present invention, such objects are accomplished by providing a foldable table comprising a table plate having a table plate bracket appending therefrom, a support having a support bracket, and at least one leg and a pivot pin passing through both the table bracket and the support bracket for a hinge motion of the table plate relative to the support, further comprising, a first cam pivoted to the table plate bracket and having a pair of cut-outs, a second cam adapted to fit into one of the two cut-outs of the first cam, a stopper pin fixed to the support bracket adapted to fit into the other of the two cut-outs of the first cam, the first cam having a first position in which the second cam is engaged with the first cut-out of the first cam and the stopper pin is engaged with the second cutout for an unfolded position of the table plate and a second position in which both the projection of the second cam and the stopper pin are disengaged from the corresponding cutouts of the first cam respectively for a folded position of the table plate, the first cam being biased by a spring means toward the second position so that the first cam rotates into the second position upon disengagement of the second cam from the first cut-out, the first cam being adapted to rotate from the second position to the first position as the stopper pin is pushed against a surface of the first cam connecting the two cut-outs to ultimately come into engagement with the first cut-out of the first cam.

BRIEF DESCRIPTION OF THE DRAWINGS

Now the present invention is described in the following with reference to the appended drawings, in which.

DETAILED DESCRIPTION OF THE PREFERRED EMBODIMENT

Figure 2:
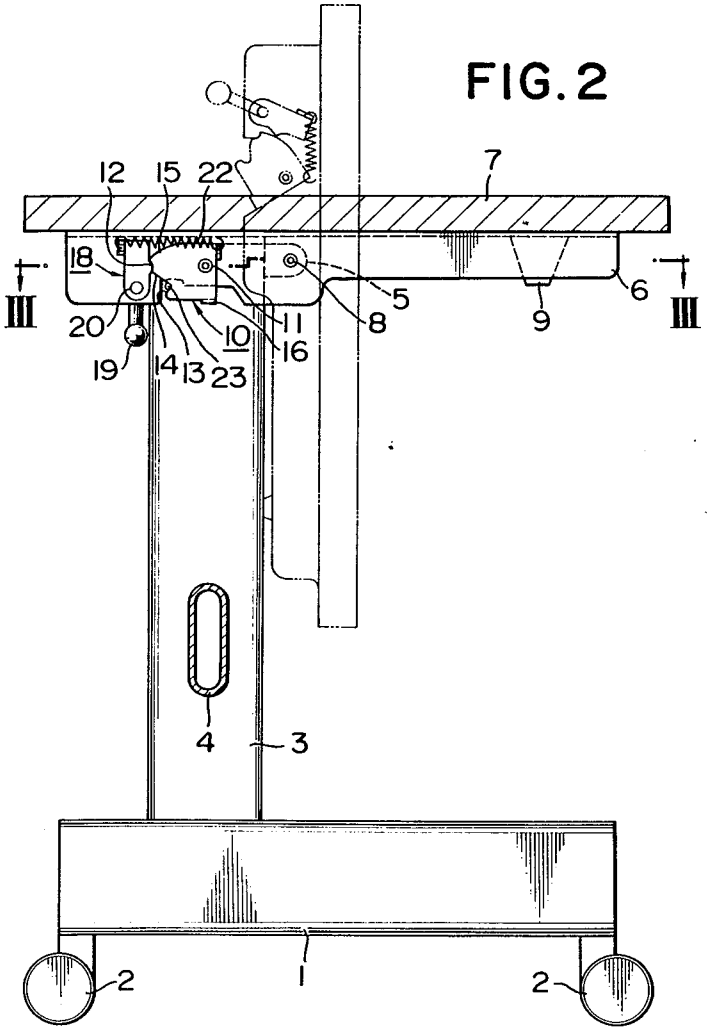
FIG. 2 is a sectional view taken along line II-II of FIG. 1.
Figure 1:
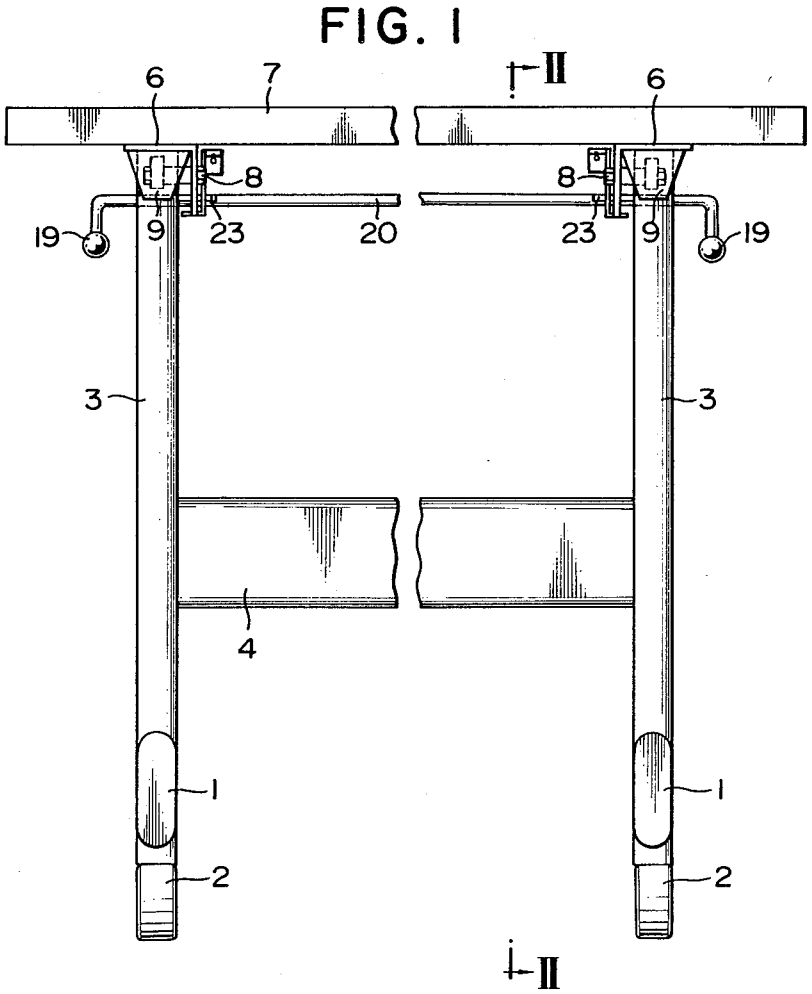
FIG. 1 is a front view showing an embodiment of the foldable table according to this invention.

In FIG. 1 and 2, numeral 1 denotes a pair of horizontal tubular bases which ride each on a pair of casters 2, respectively, fixed to the lowermost portion of the bases 1. A pair of likewise tubular support legs 3 are fixed on top of the bases 1 and extend vertically upwards. The two support legs 3 are mutually connected by a lateral member 4 with an elliptic tubular cross-section.

A table plate bracket 6 with an L-shaped cross-section is appended from the lower surface of a table plate 7 along its two side ends, and a support bracket 5 projects forwardly (to the right in FIG. 2) from the top end of each of the support legs 3. A pivot pin 8 is passed through a part of the support bracket 5 slightly to the rear of its center (left of its center in FIG. 2) and the table plate bracket 6 on each side end of the table plate 7 so that the table plate 7 is freely pivotable with respect to the support legs 3 about a lateral line passing through the pivot pins 8 and can tilt forwardly under its own weight without any constraint.

When the table plate 7 has pivoted about 90 degrees from the position shown in FIG. 2 to the position indicated by an imaginary line in the same drawing, a pair of rubber pieces 9 fixed to the lower surface of the table plate 7 come into contact with the front surfaces of the support legs 3 thus absorbing the impact of the table plate 7 when it hits the support legs 3.

Numeral 10 denotes a first cam which is pivoted to the table bracket 6 by means of a cam pin 11 located slightly rearwardly of the pivot pin 8. In the rear end of the first cam 10 are provided an upper cut-out 12 and a lower cut-out 13 each opening toward the rear. The upper cut-out 12 has a sliding surface 14 and 15 on its both sides smoothly connected thereto and the lower sliding surface 14 further connects to the lower cut-out 13 smoothly.

Figure 3:
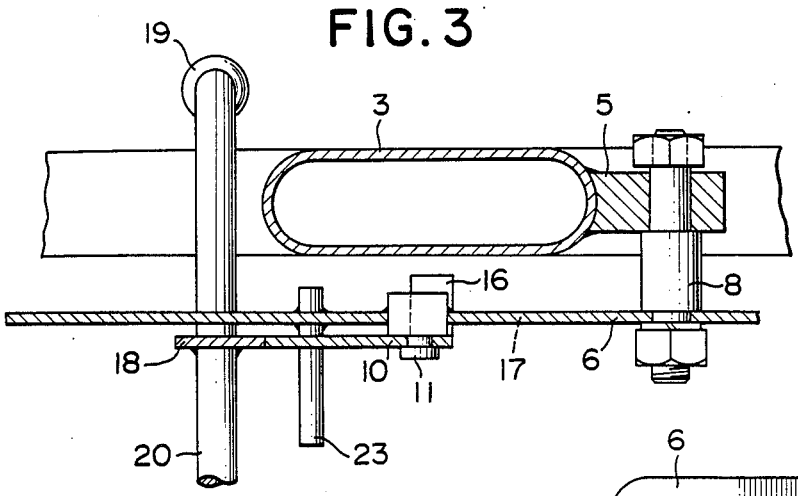
FIG. 3 is sectional view taken along line III-III of FIG. 2.
Figure 5:
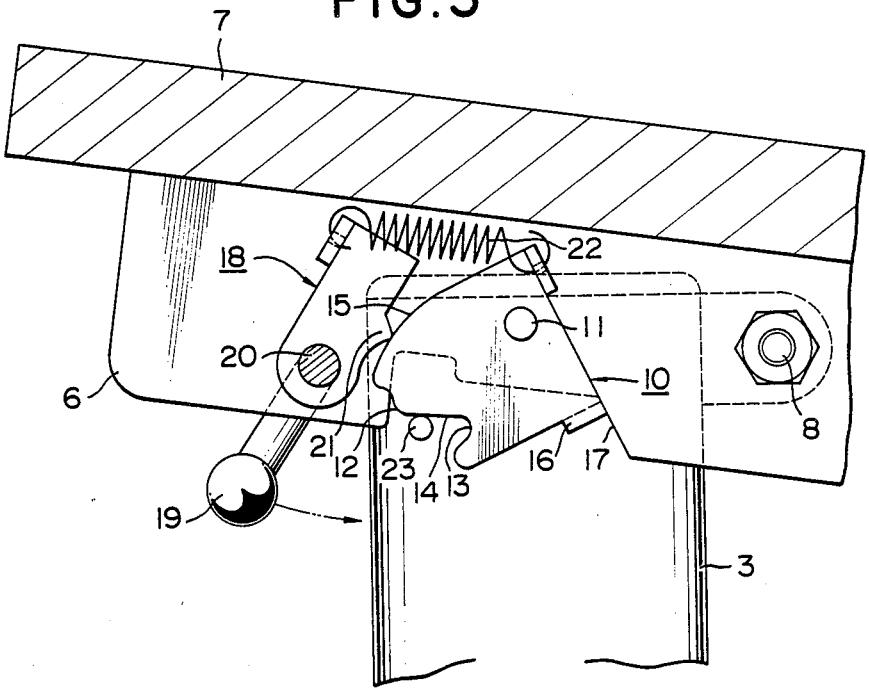
FIG. 5 is a view similar to FIG. 4 when the handle for folding the table plate is turned.

On lower end of the first cam 10 is integrally provided a stopper 16 extending laterally so as to limit the counter-clockwise rotation of the first cam 10 (FIG. 3) by the stopper coming into contact with a sloping end surface 17 formed on the table plate bracket 6 as shown in FIG. 5.

Figure 4:
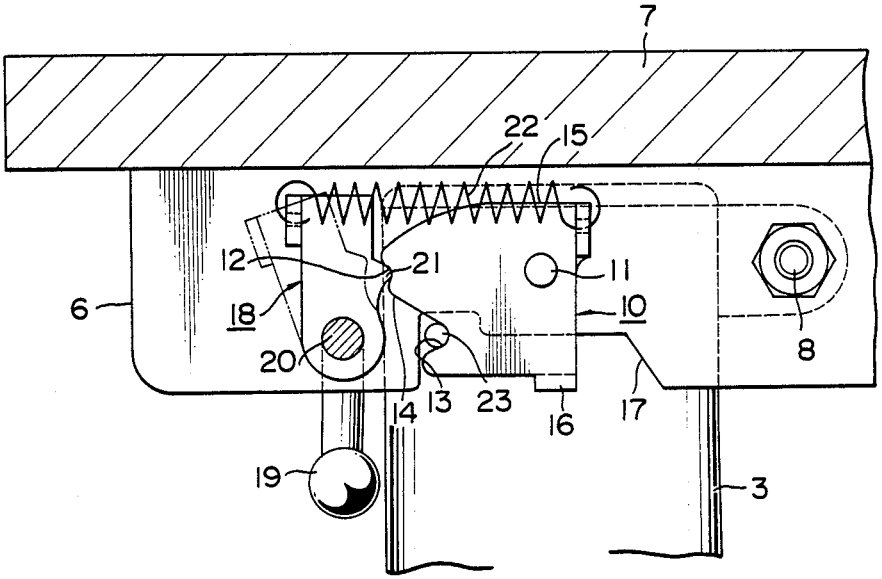
FIG. 4 is an expanded partial view of FIG. 2 when the foldable table is ready for use.

A second cam 18 is pivoted on the table plate bracket 6 further rearwardly of the first cam 10 by a pivot shaft 20 passing through both the table plate brackets 6. The two ends of the pivot shaft 20 are bent downwardly as shown in FIG. 4 and have round knobs 19 at their extreme ends. Since the second cams 18 are both fixed to the pivot shaft 20, the second cam 18 may be rotated by forcing the knobs 19 in either direction. And, since the knobs 19 are accessible from either one of the two side ends of the plate 7, the rotation of the second cams 18 may be effected from either side.

On the front end surface of the second cam is provided a projection 21 which can snugly fit into the upper cut-out 12 of the first cam 10. The upper portions of the two cams 10 and 18 are mutually connected by a coil spring 22 biasing the two upper portions towards each other.

When the table is in its working position or when the table plate 7 is placed horizontally, a laterally projecting stopper pin 23 provided on the support leg 3 snugly fit into the lower cut-out l3 of the first cam 10 and the projection 21 on the second cam 18 fits into the upper cut-out 12.

Now the manner in which the table plate 7 is folded down into the vertical position and back into the horizontal position is described in the following with reference to FIGS. 4 to 6.

Assume that the table plate 7 is initially horizontal as shown in FIG. 4. When the knob 19 of the pivot shaft 20 is rotated counter-clockwise as indicated by an arrow, the second cam 18 also rotates counter-clockwise and its projection 21 becomes disengaged from the upper cut-out 12 of the first cam 10. Then the first cam 10 rotates counterclockwise under the action of the coil spring 22 until its lower sliding surface 14 comes into contact with the laterally extending stopper pin 23 provided on the support leg 3.

By this time, the operator who initially moved the knob 19 may release it and the second cam 18 is pivoted clockwise until the projection 21 comes into contact with the upper sliding surface 15 of the first cam 10 likewise under the action of the coil spring 22.

Once the lower cut-out 13 is disengaged from the stopper pin the table plate 7 may rotate clockwise about the pivot pin 8 under the action of its own weight. An early phase of the rotation of the table plate 7 from the horizontal position is shown in FIG. 5.

Figure 6:
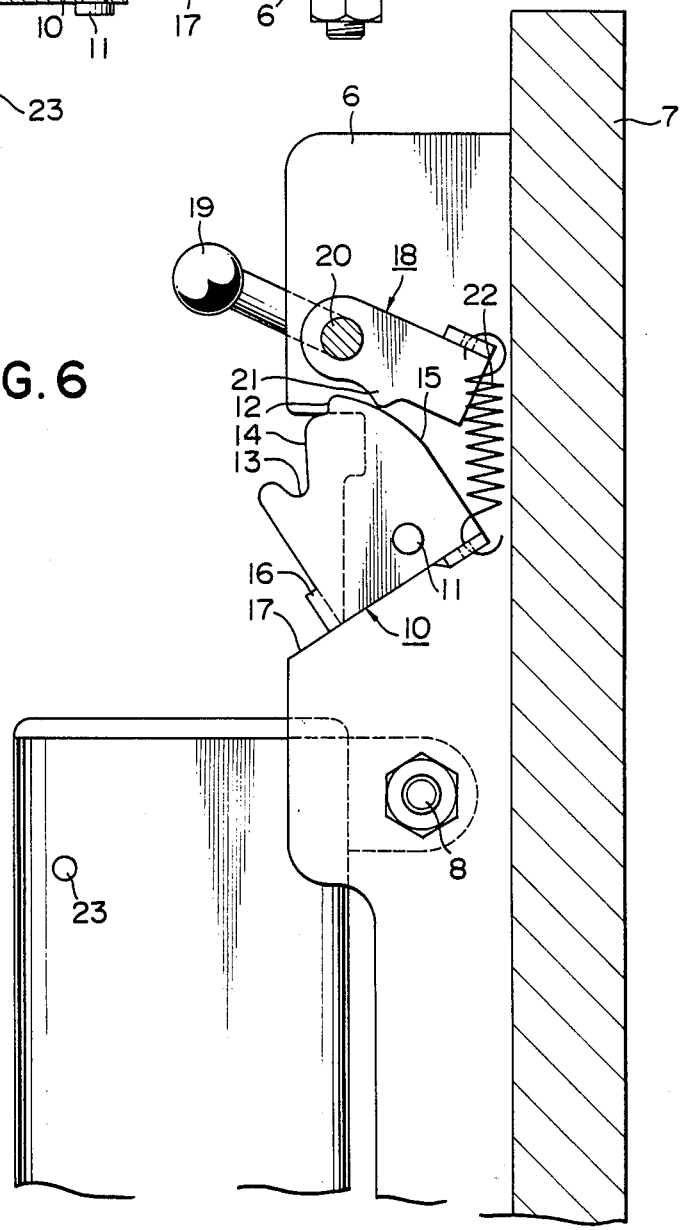
FIG. 6 is a view similar to FIG. 4 when the table plate is completely folded down.

The table plate 7 eventually assumes the vertical position shown in FIG. 6. When the table plate 7 has been thus folded into the vertical position, a number of tables made of the same structure may be stored on a small floor area since the table plates are now out of the way and the support bases may be interposed in the space between the support bases of the neighboring tables if they are slightly offset laterally from each other.

Now, in order to restore the table plate 7 back to its horizontal position, it suffices if the folded table plate 7 is rotated counter-clockwise by lifting its bottom end which corresponds to the front end when the table plate is in its horizontal position until the table plate 7 returns to its original horizontal position.

As the table plate 7 pivots about the pivot pin 8, the stopper pin 23 contacts the lower sliding surface 14 of the first cam 10. As the table plate 7 is further rotated counterclockwise and the stopper pin 23 slides over the lower sliding surface 14 until the projection 21 of which second cam which has been sliding along the upper sliding surface 15 of the first cam 10 snugly fits into the upper cut-out 12 substantially at the same time as the stopper pin snugly fits into the lower cut-out 13 of the first cam 10. In this state, the table plate 7 is secured at is horizontal position and may be used for its normal purposes.

Thus, according to the present invention, a table may be conveniently folded down simply by moving a handle knob which is accessible from either one of the two side ends of the table and restored to its useful state simply by lifting the table plate to its normal position with the two cams functioning as a latch. If such a table is used in a large number in a hall or a conference room, an open space may be readily provided by folding down each of the tables and conveniently storing them in a corner of the room.

Although the present invention was described above in terms of a specific embodiment, it is obvious to a person skilled in the art that there are a variety of possible modifications without departing from the spirit of the present invention. For instance, the second cam was described as a rotary cam, but it may be a cam of other type, such a linear cam or even a plunger. Also, the coil spring connecting the two upper portions of the two cams may be replaced by another arrangement of spring means. For instance, the spring means may consist of two separate springs of arbitrary type appropriately biasing the first and the second cams independently.

What we claim are:

1. A support surface movable between two positions, comprising:

means for movably supporting said support surface between two positions;

an engagement pin fixedly mounted upon said means supporting said support surface;

a first latching member pivotably mounted upon said support surface, and including first and second notched portions, said first notched portion being engageable with said engagement pin so as to retain said support surface in a first one of said two positions;

a second latching member, fixedly secured directly upon a shaft rotatably mounted within said support surface, having a projection engageable with said second notched portion of said first latching member whereby said second latching member is disposed in a locked position so as to retain said first latching member in engagement with said engagement pin;

spring-biasing means for interconnecting said first and second latching members together; and manually accessible lever means, fixedly connected directly to said shaft upon which said second latching member is fixedly secured, for rotating said shaft and said second latching member from said locked position to a release position so as to permit said first latching member to be disengaged from said engagement pin under the influence of said spring-biasing means whereby said support surface is able to be moved from said first one of said two positions to a second one of said two positions.

2. A support surface as set forth in claim 1, wherein: said support surface is a table-top.

3. A support surface as set forth in claim 2, wherein: said first one of said two positions defines a horizontal support mode; and said second one of said two positions defines a vertical storage mode.

4. A support surface as set forth in claim 1, wherein: said first and second notched portions of said first latching member are vertically spaced with respect to each other.

5. A support surface as set forth in claim 4, wherein: said first notched portion is disposed beneath said second notched portion.

6. A support surface as set forth in claim 1, wherein:

the pivotal and rotatable axes of said first and second latching members, respectively, are disposed parallel to each other.

7. A support surface as set forth in claim 6, wherein: said spring-biasing means is connected to said first and second latching members at upper portions thereof above their respective pivotal and rotatable axes.

8. A support surface as set forth in claim 1, wherein: said manually accessible lever means is integral with said rotatable shaft.

9. A support surface as set forth in claim 8, wherein: said lever means comprises manually graspible control knobs.

* * * * *